US010837089B2

(12) United States Patent
Yang et al.

(10) Patent No.: US 10,837,089 B2
(45) Date of Patent: Nov. 17, 2020

(54) THICK STEEL PLATE FOR HIGH HEAT INPUT WELDING AND HAVING GREAT HEAT-AFFECTED AREA TOUGHNESS AND MANUFACTURING METHOD THEREFOR

(71) Applicant: BAOSHAN IRON & STEEL CO., LTD., Shanghai (CN)

(72) Inventors: Jian Yang, Shanghai (CN); Shan Gao, Shanghai (CN); Zhigang Ma, Shanghai (CN); Ruizhi Wang, Shanghai (CN); Caiyi Zhang, Shanghai (CN); Junkai Wang, Shanghai (CN); Guodong Xu, Shanghai (CN); Yunan Wang, Shanghai (CN)

(73) Assignee: Baoshan Iron & Steel Co., Ltd., Shanghai (CN)

( * ) Notice: Subject to any disclaimer, the term of this patent is extended or adjusted under 35 U.S.C. 154(b) by 160 days.

(21) Appl. No.: 16/062,880

(22) PCT Filed: Dec. 8, 2016

(86) PCT No.: PCT/CN2016/109024

§ 371 (c)(1),
(2) Date: Jun. 15, 2018

(87) PCT Pub. No.: WO2017/107778

PCT Pub. Date: Jun. 29, 2017

(65) Prior Publication Data

US 2018/0371587 A1 Dec. 27, 2018

(30) Foreign Application Priority Data

Dec. 22, 2015 (CN) ..... 2015 1 0974660

(51) Int. Cl.

| | |
|---|---|
| ***C21D 1/02*** | (2006.01) |
| ***C22C 38/14*** | (2006.01) |
| ***C21D 6/00*** | (2006.01) |
| ***C21D 1/56*** | (2006.01) |
| ***C21D 8/02*** | (2006.01) |
| ***C21D 1/84*** | (2006.01) |
| ***C21D 9/46*** | (2006.01) |
| ***C21D 1/60*** | (2006.01) |
| ***C21D 7/13*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/08*** | (2006.01) |
| ***C22C 38/16*** | (2006.01) |
| ***C22C 38/18*** | (2006.01) |

(52) U.S. Cl.

CPC ..... *C22C 38/14* (2013.01); *C21D 1/02* (2013.01); *C21D 1/56* (2013.01); *C21D 1/60* (2013.01); *C21D 1/84* (2013.01); *C21D 6/001* (2013.01); *C21D 6/004* (2013.01); *C21D 6/005* (2013.01); *C21D 6/008* (2013.01); *C21D 7/13* (2013.01); *C21D 8/0226* (2013.01); *C21D 8/0263* (2013.01); *C21D 9/46* (2013.01); *C22C 38/001* (2013.01); *C22C 38/002* (2013.01); *C22C 38/005* (2013.01); *C22C 38/02* (2013.01); *C22C 38/04* (2013.01); *C22C 38/06* (2013.01); *C22C 38/08* (2013.01); *C22C 38/16* (2013.01); *C22C 38/18* (2013.01)

(58) Field of Classification Search

CPC .. C21D 1/02; C21D 6/001; C21D 9/46; C22C 38/001

USPC ..... 148/330

See application file for complete search history.

(56) References Cited

FOREIGN PATENT DOCUMENTS

| | | | |
|---|---|---|---|
| CN | 101182618 A | | 5/2008 |
| CN | 102605247 A | * | 7/2012 |
| CN | 102676950 A | | 9/2012 |
| CN | 103695777 | | 4/2014 |
| CN | 103695777 A | | 4/2014 |
| JP | 2010095781 | | 4/2010 |
| JP | 5394785 | | 10/2010 |

(Continued)

OTHER PUBLICATIONS

NPL: Machine translation of JP2011219797A, Nov. 2011 (Year: 2011).*

(Continued)

*Primary Examiner* — Jie Yang

(74) *Attorney, Agent, or Firm* — Thomas Horstemeyer, LLP

(57) ABSTRACT

A thick steel plate for high heat input welding and having great heat-affected area toughness and a manufacturing method therefor, comprising the steps of smelting, casting, rolling, and cooling. Also, the chemical composition of the steel plate satisfies $1 \leq Ti/N \leq 6$ and $(Ca+REM+Zr)/Al \geq 0.11$, where the effective S content in steel=S-0.8Ca-0.34REM-0.35Zr. and the effective S content in steel: 0.0006-0.005%; finely dispersed inclusions may be formed, and the amount of composite inclusion $CaO+Al_2O_3+MnS+TiN$ in the steel plate is at a proportion of ≥12%. With respect to welding in which the thickness of the steel plate is 50-70 mm, the tensile strength of a base material is ≥510 MPa. and welding input energy is 200-400 kJ/cm, the average Charpy impact work of a welding heat-affected area of the steel plate at −40° C. is 100 J or more, and at the same time, the average Charpy aging impact work of the base material of ½ thickness at −40° C. is 46 J or more.

4 Claims, No Drawings

(56) References Cited

FOREIGN PATENT DOCUMENTS

| | | | |
|---|---|---|---|
| JP | 2011219797 | A | 11/2011 |
| JP | 2013147741 | A | 8/2013 |
| JP | 2013194316 | A | 9/2013 |

OTHER PUBLICATIONS

NPL: Machine translation of CN103695777A, Apr. 2014 (Year: 2014).*
NPL: On-line translation of CN102605247A, Jul. 2012 (Year: 2012).*
1st Office Action dated Jan. 10, 2018 for Chinese Patent Application No. 201510974660.
2nd Office Action dated Jul. 27, 2018 for Chinese Patent Application No. 201510974660.
European Search Report dated May 8, 2019 for European Patent Application 16877589.8.
International Search Report and Written Opinion dated Feb. 23, 2017 for PCT Patent Application No. PCT/CN2016/109024.

* cited by examiner

THICK STEEL PLATE FOR HIGH HEAT INPUT WELDING AND HAVING GREAT HEAT-AFFECTED AREA TOUGHNESS AND MANUFACTURING METHOD THEREFOR

CROSS-REFERENCE TO RELATED APPLICATIONS

This is a national stage filing in accordance with 35 U.S.C. § 371 of PCT/CN2016/109024, filed Dec. 8, 2016, which claims the benefit of the priority of Chinese Patent Application No. 201510974660.4, filed Dec. 12, 2015, the contents of each are incorporated herein by reference.

TECHNICAL FIELD

The present invention belongs to the steel metallurgy and steel material fields. Particularly, the present invention relates to a thick steel plate for high heat input welding and having great heat-affected area toughness and a manufacturing method therefor, wherein the thickness of the steel plate is 50-70 mm, the tensile strength of a base material is ≥510 MPa, and welding input energy is 200-400 kJ/cm, the average Charpy impact work of a welding heat-affected area of the steel plate at −40° C. is 100 J or more, and at the same time, the average Charpy aging impact work of the base material of ½ thickness at −40° C. is 46 J or more.

BACKGROUND TECHNOLOGY

In the fields of shipbuilding, construction, pressure vessels, oil and gas pipelines, and offshore platforms, improving the high heat input welding performance of thick steel plates can improve welding efficiency, shorten manufacturing hours, and reduce manufacturing costs, thus improving welding heat-affected area toughness of thick steel plates has become an urgent requirement.

After high heat input welding, the microstructure of the steel is destroyed and Austenite grains grow significantly, forming a coarse-grained heat affected zone and reducing the toughness of the welding heat-affected area. The structure that causes brittleness in the coarse-grained heat-affected zone is the coarse grain boundary ferrite, ferrite side-plate, and upper bainite formed during cooling, and the pearlite formed on the vicinity of the grain boundary ferrite, Carbide island MA components formed between the side-plates of the ferrite side-plate, and the like. With the increase of the grain size of the old Austenite grains, the size of the grain boundary ferrite and the ferrite side-plate also will increase, but the Charpy impact work of the welding heat-affected area will be significantly reduced.

Under high heat input welding conditions, a lot of research work has been carried out in order to improve the low temperature toughness of the welding heat-affected area of thick steel plates.

For example, Japanese Patent No. 5116890 discloses a method for manufacturing a high tensile steel product for large-scale hot-junction welding. During the design of steel materials, a certain amount of Ti and N are added to the composition, and the use of TiN particles can suppress the deterioration of the welding heat-affected area toughness. Moreover, welding heat input can be increased to 50 kJ/cm. However, when the welding heat input reaches 200 kJ/cm or more, the temperature of the welding heat-affected area will be as high as 1400° C. during the welding process so as to a part of the TiN particles will undergo solid solution or growth, its function of inhibiting the growth of the grains of welding heat-affected area will disappear, leading to deterioration of the welding heat-affected area toughness. Therefore, it is difficult to improve the high heat input welding performance of the thick steel plate using only the fine-grained TiN steel.

The use of titanium oxide can also improve the toughness of welding heat-affected area of the steel for high heat input. This is because titanium oxides are stable at high temperatures and do not occur solid-solution. At the same time, titanium oxide can act as a nucleation core of ferrite, refine ferrite grains, and form acicular ferrite structure with large dip angle between grains, which is beneficial to improving the toughness of welding heat-affected area. It was described in Japanese patent No.

JP 517300, "Method of Manufacturing Steel for Heat-Responsiveness of Heat-affected Parts".

However, there are two major problems that titanium oxide is presented in a small amount and is difficult to disperse in the steel. If it is desired to increase the amount of titanium oxide by increasing the titanium content in the steel, it will result in the formation of large titanium oxide inclusion. When the size of the titanium oxide particles is more than 5 μm, the impact toughness of the base material and the welding heat-affected area will be reduced. Therefore, in the welding process of high heat input which welding heat input is greater than 200 kJ/cm, it is still difficult to improve the toughness of the welding heat-affected area by using oxide of titanium alone.

SUMMARY OF THE INVENTION

The object of the present invention is to provide a thick steel plate for high heat input welding and having great heat-affected area toughness and a manufacturing method therefor, wherein the thickness of the steel plate is 50-70 mm, the tensile strength of a base material is ≥510 MPa; and the impact toughness of a welding heat-affected area of the steel plate is $_{v}E_{-40}$≥100 J under the condition that welding heat input is 200-400 kJ/cm, and at the same time, the average Charpy aging impact work of the base material of ½ thickness at −40° C. is 46 J or more.

To achieve the above object, the technical solution of the present invention is:

A thick steel plate for high heat input welding and having great heat-affected area toughness, having the chemical composition in mass percentage: C: 0.05~0.08%, Si: 0.10~0.3006, Mn: 1.2~1.6%. P≤0.02%, S: 0.002~0.008%, B: 0.0005~0.0056, Ni: 0.20~0.4006, Cu: 0.15~0.3%. Ti: 0.005~0.03%, Al: 0.003~0.0306, Ca: 0.001~0.005° 0, REM≤0.01%, Zr≤0.01%, N: 0.001~0.006%, and the balance of Fe and other inevitable impurities; and, the chemical composition satisfying the following relationship:

$$1 \le Ti/N \le 6, (Ca+REM+Zr)/Al \le 0.11;$$

an effective S content in steel=S-0.8Ca-0.34REM-0.35Zr;

an effective S content in steel: 0.0006~0.005%;

the amount of composite inclusion $CaO+Al_2O_3+MnS+TiN$ in the steel plate is at a proportion of ≥12%.

Preferably, the chemical composition of the steel plate further contains at least one element of Nb≤0.03% or Cr≤0.2% in mass percentage.

Another object of the present invention is to provide a method of manufacturing a thick steel plate for high heat input welding and having great heat-affected area toughness, wherein the method comprises the following steps:

1) Smelting, refining and continuous casting,

Smelting, refining, continuous casting to obtain a slab for the steel plate having a chemical composition in mass percentage: C: 0.05~0.08%, Si: 0.10~0.30%, Mn: 1.2~1.6%, P≤0.02%, S: 0.002~0.008%, B: 0.0005~0.005%, Ni: 0.20~0.40%, Cu: 0.15~0.3%, Ti: 0.005~0.03%, Al: 0.003~0.03%, Ca: 0.001~0.005%, REM≤0.01%, Zr≤0.01%, N: 0.001~0.006%, and the balance of Fe and other inevitable impurities; and the chemical composition satisfying the following relationship:

$$1 \le Ti/N \le 6, (Ca+REM+Zr)/Al \ge 0.11;$$

an effective S content in steel=S-0.8Ca-0.34REM-0.35Zr;

an effective S content in steel: 0.0006~0.005%;

the amount of composite inclusion $CaO+Al_2O_3+MnS+TiN$ in the steel plate is controlled at a proportion of ≥12%.

2) Rolling,

Heating the slab to 1050-1250° C., the initial rolling temperature is higher than 930° C., the cumulative reduction rate is greater than 30%; the finish rolling temperature is less than 930° C., and the cumulative reduction rate is greater than 30%;

3) Cooling,

Performing water cooling at a cooling rate of 2 to 30° C./s to a final cooling temperature of 300 to 550° C.

Preferably, the chemical composition of the steel further contains at least one element of Nb≤0.03% or Cr≤0.2% in mass percentage.

In the ingredient design of the steel of the present invention:

C, is an element that increases the strength of steel. For the TMCP process used to control rolling and cooling, in order to maintain a specific strength, the lower limit of the C content is 0.05%. However, if C is added excessively, the toughness of the base material and the welding heat-affected area will be reduced. The upper limit of the C content is 0.08/%.

Si, is an element that is required to use in the process of pre-deoxidation of steelmaking, and can have a function of reinforcing base material. Therefore, the lower limit of Si content is 0.1%. However, if the Si content is more than 0.3%, the toughness of the base material will be reduced. At the same time, during the high heat input welding process, the formation of island-like Martensite-Austenite component will be promoted, which will significantly reduce the welding heat-affected area toughness. The Si content is in a range from 0.10 to 0.30%.

Mn can increase the strength of the base material by solid-solution strengthening and can also act as a pre-deoxidation element. Simultaneously, MnS precipitates on the surface of the oxide inclusions, and forms a poor Mn layer around the inclusions, which can effectively promote the formation of intracrystalline acicular ferrite. The lower limit of Mn is 1.2%. However, if the content of Mn is too high, it will lead to center segregation of the slab, and at the same time, it will lead to hardening of high heat input welding heat-affected area, generation of MA, and reduction of the toughness of the welding heat-affected area, so the upper limit of Mn is controlled to be 1.6%.

Ni can increase the strength and toughness of the base material, and its lower limit is 0.2%. However, due to its high price, the upper limit thereof is 0.4% in consideration of cost.

Cu can increase the strength and toughness of the base material, and its lower limit is 0.15%. However, if the Cu content is too high, it will cause hot brittleness, and the upper limit of Cu is 0.3%.

Ti can promote the formation of intracrystalline ferrite by forming $Ti_2O_3$ particles. At the same time, TiN particles formed by the bonding of Ti and N can pin the growth of Austenite grains, refine the base material and the welding heat-affected area, and increase the toughness. Such TiN particles can easily precipitate on the surface of the $CaO+Al_2O_3$ oxide particles. Since TiN and ferrite have a small degree of lattice mismatch, acicular ferrite can be induced to grow on the surface thereof. Therefore, as a beneficial element, the lower limit of the Ti content is 0.005%. However, when the Ti content is too high, coarse nitrides are formed, or the formation of TiC is promoted, leading to the reduction of the toughness of the base material and the welding heat-affected area. Thus, the upper limit of the Ti content is 0.03%.

N, can form fine Ti nitrides, which can effectively suppress the growth of Austenite grain during high heat input welding. At the same time, the TiN particles can easily precipitate on the surface of the $CaO+Al_2O_3$ oxide particles. Since the TiN and the ferrite have a small degree of lattice mismatch, acicular ferrite can be induced to grow on the surface thereof. So as a beneficial element, the lower limit thereof is 0.001%. However, if the content of N is more than 0.006%, it will lead to the formation of solid-solution N and reduce the toughness of base material and welding heat-affected area.

At the same time, it is necessary to maintain a suitable Ti/N ratio in the steel, wherein the ratio is $1 \le Ti/N \le 6$. When Ti/N is less than 1, the number of TiN particles will drastically decrease, and a sufficient amount of TiN particles cannot be formed, suppressing the growth of Austenite grain during high heat input welding, and reduce the toughness of the welding heat-affected area. When Ti/N is greater than 6, the TiN particles are coarsened, and the excess Ti can easily bond with C to form coarse TiC particles. These coarse particles may serve as the starting point of crack generation, lowering the impact toughness of the base material and the welding heat-affected area.

Al: when the Al content in the steel is too high, cluster alumina inclusions are easily formed, which is not conducive to the formation of finely diffuse distribution inclusions. Therefore, the upper limit of the Al content is 0.03%. At the same time, maintaining a specific Al content in the steel can improve the cleanliness of the molten steel and reduce the total oxygen content in the steel, thereby increasing the impact toughness of the steel. Therefore, the lower limit of the Al content is 0.003%.

Ca: the addition of Ca can improve the morphology of sulfides, and Ca oxides and sulfides can also promote the growth of intracrystalline ferrite. The combination of CaO and $Al_2O_3$ can form the low-melting inclusions and improve the morphology of inclusions. These inclusions have higher sulfur capacity, which helps to promote the precipitation of MnS on the surface and promote the precipitation of TiN. When the content of Ca in the steel is less than 0.001%, the ratio of (Ca+REM+Zr)/Al in the steel cannot meet the requirement of 0.11 or more, and the amount at a proportion of composite inclusion $CaO+Al_2O_3+MnS+TiN$ cannot satisfy the requirement of 12% or more. The impact toughness of the welding heat-affected area is reduced. If the Ca content is more than 0.005%, the effect of Ca is already saturated, and Ca evaporation loss and oxidation loss are increased. Therefore, a reasonable range of Ca content is: 0.001 to 0.005%.

REM and Zr: The addition of REM and Zr can improve the morphology of sulfide, and the REM and Zr oxides and sulfides can inhibit the growth of Austenite grains during the welding thermal cycle. However, when the content of REM and Zr is more than 0.01%, inclusions with a particle diameter of more than 5 μm will be generated, and the impact toughness of the base material and the welding heat-affected area will be reduced.

B: By forming BN, growth of Intracrystalline ferrite can be promoted, and as solid-solution B, it is segregated in the Austenite grain boundary during cooling after welding, so that generation of grain boundary ferrite is suppressed. In order to increase the impact toughness of the welding heat-affected area, the lower limit of the B content is 0.0005%. However, when the B content is too high, the hardenability will significantly increase, and the toughness and ductility of the base material will be reduced. The upper limit of B is 0.005%.

S: sulfide particles formed by S with Ca and/or RE and Zr are precipitated during the addition of Ca and/or RE and Zr. It is also possible to promote the precipitation of MnS on the oxide particles, especially on the surface of $CaO+Al_2O_3$. Thereby, the formation of intracrystalline ferrite is promoted. The lower limit of S is 0.002%. However, excessively high levels will result in the center segregation of the slab. In addition, when the S content exceeds 0.008%, a part of coarse sulfides will be formed, and these coarse sulfides will serve as starting points of crack formation, thereby lowering the impact toughness of the base material and the welding heat-affected area. Therefore, the upper limit of the S content is 0.008%.

The present invention finds the following conclusions through a lot of research: An effective S content in the steel=S-0.8Ca-0.34REM-0.35Zr. When the effective S content in steel is less than 0.0006, it cannot meet the requirement for a large amount of MnS precipitation, and the amount at a proportion of composite inclusion $CaO+Al_2O_3+MnS+TiN$ cannot satisfy the requirement of 12% or more. Because the amount of acicular ferrite formed on the surface of composite inclusion $CaO+Al_2O_3+MnS+TiN$ is reduced, the impact toughness of the high heat input welding heat-affected area will be greatly reduced. When the effective S content is more than 0.005%, it will lead to a sharp increase in the number of elemental MnS inclusions, and the size of the MnS inclusions will grow significantly. These large-scale MnS inclusions will extend along the rolling direction during rolling, which will greatly reduce the Horizontal impact performance of steel. Therefore, the effective S content in steel is controlled in a range from 0.0006 to 0.005%.

The contents in above formula are all calculated as actual values, excluding %.

In the present invention, the composition of the inclusions is determined by SEM-EDS. After grinding and mirror polishing of the sample, the inclusions are observed and analyzed using the SEM. The composition of the inclusions of each sample is the average value of analysis result of 10 randomly selected inclusions.

50 continuous selection of view field having an area of greater than 0.27 $mm^2$ are observed using SEM at a magnification of 1000 times. The areal density of inclusions is the calculation result of the number of inclusions observed and the area of the view field. The amount at a proportion of a certain inclusion is the ratio of the areal density of this inclusion to the areal density of all kinds of inclusions.

P, which is an impurity element in steel, should be reduced as much as possible. If the content thereof is too high, it will lead to center segregation and reduce the toughness of the welding heat-affected area. The upper limit of P is 0.02%.

Nb, can refine the organization of steel and increase strength and toughness. However, if its content is too high, the toughness of the welding heat-affected area will be reduced. The upper limit is 0.03%.

Cr can improve the hardenability of the steel. For thick steel plates, improving hardenability can compensate the strength loss caused by the thickness, thereby increasing the strength of the center region of the plate thickness, and improving the uniformity of the performance in the thickness direction. However, when Cr and Mn are added at too high levels, a low-melting-point Cr—Mn composite oxide is formed, and surface cracks are easily formed during hot rolling. And at the same time, the welding performance of the steel is also affected. Therefore, the upper limit of Cr content is 0.2%.

In the rolling and cooling process of the present invention:

When the heating temperature before rolling is less than 1050° C., the carbonitride of Nb cannot completely be solid-dissolved. When the heating temperature is higher than 1250° C., it will lead to the growth of Austenite grain.

The initial rolling temperature is higher than 930° C., and the cumulative reduction rate is more than 30%. While the temperature is higher than 930° C., recrystallization occurs and Austenite grains can be refined. When the cumulative reduction rate is less than 30%, the coarse Austenite grains formed during the heating process will remain, reducing the toughness of the base material.

The finish rolling temperature is less than 930° C. and the cumulative reduction rate is greater than 30%. At this temperature, Austenite grain does not recrystallize. The dislocations formed during the rolling process can act as the core of ferrite nucleation. When the cumulative reduction rate is less than 30%, a small amount of dislocations are formed, which is not sufficient to induce nucleation of acicular ferrite.

After finish rolling, Water cooling is performed at a cooling rate of 2 to 30° C./s to a final cooling temperature of 300 to 550° C., the reasons are as follows:

When the cooling rate is less than 2° C./s, the strength of the base material cannot meet the requirement. When the cooling rate is greater than 30° C./s, the toughness of the base material will be reduced. When the final cooling temperature is greater than 550° C., the strength of the base material cannot meet the requirements. When the final cooling temperature is less than 300° C., the toughness of the base material will be reduced.

The beneficial effects of the present invention are as follows:

The present application adopts appropriate ingredient design and inclusion control techniques. By controlling appropriately Ti/N ratio and (Ca+REM+Zr)/Al ratio in steel, the effective S content in steel and the amount at a proportion of composite inclusion $CaO+Al_2O_3+MnS+TiN$ in the steel plate, during solidification and phase change, the growth of intracrystalline acicular ferrite on the surface of these inclusions is promoted, or the growth of Austenite grains during high heat input welding is suppressed, and the high heat input welding performance of the thick steel plate is improved. The thickness of the steel plate produced is 50-70 mm, the tensile strength of a base material is ≥510 MPa, and welding input energy is 200-400 kJ/cm, the high heat input welding performance of the welding heat-affected area is ${}_{v}E_{-40}$≥100 J, and at the same time, the average Charpy aging impact work of the base material of ½ thickness at −40° C. is 46 J or more.

DETAILED DESCRIPTION

Hereinafter the technical solution of the present invention will be further explained with reference to examples.

Table 1 shows the chemical composition, Ti/N ratio and (Ca+REM+Zr)/Al ratio of Examples and Comparative Examples of the present invention. Table 2 shows the mechanical properties of base material, inclusion properties, and impact toughness of welding heat-affected area of Examples and Comparative Examples of the present invention.

The slab is obtained through smelting, refining and continuous casting, and then the slab is heated to 1050° C. to 1250° C., the initial rolling temperature is 1000 to 1150° C., the cumulative reduction rate is 50%; and the finishing temperature is 700 to 850° C., the cumulative reduction rate is 53% to 67%%; after the finish rolling, water cooling is performed at a cooling rate of 3 to 10° C./s to a final cooling temperature of 300 to 550° C.

Electro-pneumatic vertical welding is used to perform one pass welding for steel plates having different thickness at 200 to 400 kJ/cm of welding input energy. Impact specimens are taken from the fusion line of ½ plate thickness, and then are introduced into a V-notch for impact toughness testing. Charpy impact tests of three samples are performed at −40° C. The data of the impact toughness of the welding heat-affected area is the average value of three measurement results.

Aging impact test specimens are taken from the ½ plate thickness, then Charpy impact tests of three samples are performed at 5% strain and −40° C. The data of aging impact test sample is the average of the three measurement results.

It can be seen from Tables 1 and 2 that, in the Examples, the composition is controlled according to the chemical composition range determined by the present invention, and satisfies 1≤Ti/N≥6 and (Ca+REM+Zr)/Al≥0.11, and the effective S content in steel: 0.0006-0.005%; and the amount of composite inclusion $CaO+Al_2O_3+MnS+TiN$ in the steel plate is at a proportion of ≥12%.

In Comparative Examples 1 and 2, the Al content is greater than 0.03%, the (Ca+REM+Zr)/Al ratio is less than 0.11, the effective S content of Comparative Example 1 is less than 0.0006%, and the effective S content of Comparative Example 2 is greater than 0.005%. In addition, the amount of composite inclusion $CaO+Al_2O_3+MnS+TiN$ of Comparative Example 1 is at a proportion of less than 12%.

Table 2 shows the tensile properties, impact toughness, aging impact of the base material and impact toughness of the welding heat-affected area in the examples and comparative examples. Yield strength, tensile strength, and section shrinkage of the base material are the average value of two test data. Aging impact and Charpy impact work of welding heat-affected area at −40° C. of the base material are the average value of three test data.

From the data in the table, it can be seen that there is no obvious difference in the mechanical properties of the base material between the examples and the comparative examples, which both can satisfy the requirement that the manufactured steel plate has a thickness of 50-70 mm and a tensile strength of base material≥510 MPa. Charpy impact work of the welding heat-affected area at −40° C. is tested under the conditions of a welding input energy of 200 to 400 kJ/cm. The values of Examples 1 to 5 are 108, 125, 115, 120, and 170 (J), respectively, and the values of Comparative Examples 1 and 2 are 11, 17 (J). The impact toughness of the welding heat-affected area of Examples is greatly improved and can satisfy requirements of the high heat input welding of 200 to 400 kJ/cm.

In addition, in all Examples, the average Charpy aging impact work of the base material of ½ plate thickness at −40° C. is 46 J or more. Since the effective S content of Comparative Example 2 is too high, the aging impact performance of the ½ plate thickness is significantly reduced.

The present application adopts appropriate ingredient design. By controlling appropriately Ti/N ratio and (Ca+REM+Zr)/Al ratio in steel, the effective S content in steel, and the amount at a proportion of composite inclusion $CaO+Al_2O_3+MnS+TiN$ in the steel plate, during solidification and phase change, the growth of intracrystalline acicular ferrite on the surface of these inclusions is promoted, or the growth of Austenite grains during high heat input welding is suppressed, and the high heat input welding performance of the thick steel plate is improved. The thickness of the steel plate produced is 50-70 mm, the tensile strength of a base material is ≥510 MPa, the high heat input welding performance of the welding heat-affected area is ${}_{v}E_{-40}$≥100 J under the condition that welding input energy is 200-400 kJ/cm, and at the same time, the average Charpy aging impact work of the base material of ½ plate thickness at −40° C. is 46 J or more. The present invention can be used in the manufacturing process of thick steel plates for shipbuilding, construction, offshore platforms, bridges, pressure vessels and petroleum, natural gas pipelines and so on to improve the high heat input welding performance of thick steel plates.

TABLE 1

| No. | C | Si | Mn | P | S | Al | Ti | Ca | REM | Zr | N |
|---|---|---|---|---|---|---|---|---|---|---|---|
| Example 1 | 0.079 | 0.14 | 1.21 | 0.019 | 0.0020 | 0.017 | 0.0300 | 0.0018 | 0 | 0 | 0.0060 |
| Example 2 | 0.075 | 0.11 | 1.55 | 0.006 | 0.0051 | 0.030 | 0.0050 | 0.0010 | 0 | 0.01 | 0.0049 |
| Example 3 | 0.070 | 0.30 | 1.54 | 0.012 | 0.0072 | 0.022 | 0.0150 | 0.0050 | 0.005 | 0 | 0.0044 |
| Example 4 | 0.066 | 0.20 | 1.59 | 0.007 | 0.0080 | 0.003 | 0.0098 | 0.0020 | 0.010 | 0 | 0.0028 |
| Example 5 | 0.051 | 0.22 | 1.52 | 0.017 | 0.0070 | 0.015 | 0.0065 | 0.0025 | 0 | 0 | 0.0011 |
| Comparative Example 1 | 0.074 | 0.19 | 1.47 | 0.009 | 0.0011 | 0.035 | 0.0130 | 0.0030 | 0 | 0 | 0.0023 |
| Comparative Example 2 | 0.061 | 0.26 | 1.55 | 0.008 | 0.0098 | 0.045 | 0.0120 | 0.0020 | 0.005 | 0.002 | 0.0046 |

| No. | B | Ni | Cu | Nb | Cr | Ti/N | (Ca + REM + Zr)/Al | Effective S content |
|---|---|---|---|---|---|---|---|---|
| Example 1 | 0.0036 | 0.34 | 0.18 | 0.016 | 0.14 | 3.00 | 0.11 | 0.0006 |
| Example 2 | 0.0022 | 0.21 | 0.23 | 0.006 | 0.19 | 1.02 | 0.31 | 0.0008 |
| Example 3 | 0.0042 | 0.39 | 0.15 | 0 | 0 | 3.41 | 0.27 | 0.0015 |
| Example 4 | 0.0005 | 0.27 | 0.29 | 0.015 | 0 | 3.50 | 0.94 | 0.0030 |

TABLE 1-continued

| | | | | | | | | |
|---|---|---|---|---|---|---|---|---|
| Example 5 | 0.0050 | 0.33 | 0.26 | 0.030 | 0.13 | 5.91 | 0.12 | 0.0050 |
| Comparative Example 1 | 0.0025 | 0.36 | 0.17 | 0.016 | 0.14 | 5.65 | 0.06 | −0.0013 |
| Comparative Example 2 | 0.0015 | 0.27 | 0.20 | 0.014 | 0.10 | 2.61 | 0.07 | 0.0075 |

TABLE 2

The mechanical properties of the base material, inclusion properties, and impact toughness of the welding heat-affected area of Examples and Comparative Examples

| | | | The mechanical properties of the base material | | | | | Inclusion | HAZ toughness | |
|---|---|---|---|---|---|---|---|---|---|---|
| No. | thickness of the steel plate (mm) | hot rolling and cooling | Rp0.2 (Mpa) | Rm (Mpa) | A (%) | $_vE_{-40}$ (J) | the average aging impact work (J) of 1/2 plate thickness at −40° C., 5% strain | the amount at a proportion (%) of composite inclusion CaO + $Al_2O_3$ + MnS + TiN | welding input energy (KJ/cm) | $_vE_{-40}$ (J) |
| Example 1 | 68 | TMCP | 433 | 548 | 26 | 270 | 180 | 12.0 | 406 | 108 |
| Example 2 | 60 | TMCP | 442 | 565 | 27 | 293 | 175 | 17.2 | 430 | 125 |
| Example 3 | 50 | TMCP | 436 | 560 | 26 | 280 | 217 | 22.5 | 245 | 115 |
| Example 4 | 70 | TMCP | 432 | 550 | 25 | 320 | 235 | 35.7 | 450 | 120 |
| Example 5 | 68 | TMCP | 410 | 525 | 27 | 310 | 212 | 41.3 | 405 | 170 |
| Comparative Example 1 | 70 | TMCP | 430 | 550 | 25 | 305 | 202 | 5.1 | 410 | 11 |
| Comparafive Example 2 | 68 | TMCP | 442 | 558 | 27 | 285 | 12 | 48.2 | 385 | 17 |

The invention claimed is:

1. A thick steel plate for high heat input welding and having great heat-affected area toughness, wherein the thickness of the steel plate is 50-70 mm, the tensile strength of a base material of the steel plate is ≥510 MPa, the average Charpy impact work of the welding heat-affected area of the steel plate at −40° C. is 100 J or more under a condition that welding input energy is 200-400 kJ/cm and the average Charpy aging impact work of the base material of ½ plate thickness at −40° C. is 46 J or more, and wherein the steel plate consists essentially of a chemical composition in mass percentage:

C: 0.05-0.08%,
Si: 0.10-0.30%,
Mn: 1.2-1.6%,
P≤0.02%,
S: 0.002-0.008%,
B: 0.0005-0.005%,
Ni: 0.20-0.40%,
Cu: 0.15%-0.3%,
Ti: 0.005-0.03%,
Al: 0.003-0.03%,
Ca: 0.001-0.005%,
REM≤0.01%,
Zr≤0.01%,
N: 0.001-0.006%, and
the balance of Fe and other inevitable impurities;
wherein the chemical composition satisfies the following relationship:

$1 \leq Ti/N \leq 6$ and $(Ca+REM+Zr)/Al \geq 0.11$;

an effective S content in steel=S-0.8Ca-0.34REM-0.35Zr which is in a range of 0.0006-0.005%; and
the proportion of composite inclusion $CaO+Al_2O_3+MnS+TiN$ in the steel plate is 12% or more.

2. A thick steel plate for high heat input welding and having great heat-affected area toughness, wherein the thickness of the steel plate is 50-70 mm, the tensile strength of a base material of the steel plate is ≥510 MPa, the average Charpy impact work of the welding heat-affected area of the steel plate at −40° C. is 100 J or more under a condition that welding input energy is 200-400 kJ/cm and the average Charpy aging impact work of the base material of ½ plate thickness at −40° C. is 46 J or more, and wherein the steel plate consists essentially of a chemical composition in mass percentage:

C: 0.05-0.08%,
Si: 0.10-0.30%,
Mn: 1.2-1.6%,
P≤0.02%,
S: 0.002-0.008%,
B: 0.0005-0.005%,
Ni: 0.20-0.40%,
Cu: 0.15%-0.3%,
Ti: 0.005-0.03%,
Al: 0.003-0.03%,
Ca: 0.001-0.005%,
REM≤0.01%,
Zr 0.01%,
N: ≤0.001-0.006%,
Nb: ≤0.03% or Cr≤0.2%, and
the balance of Fe and other inevitable impurities;
wherein the chemical composition satisfies the following relationship:
$1 \leq Ti/N \leq 6$ and $(Ca+REM+Zr)/Al \leq 0.11$;
an effective S content in steel=S-0.8Ca-0.34REM-0.35Zr which is in a range of 0.0006-0.005%; and
the proportion of composite inclusion $CaO+Al_2O_3+MnS+TiN$ in the steel plate is 12% or more.

3. A method of manufacturing a thick steel plate for high heat input welding and having great heat-affected area toughness, wherein the method comprises the following steps:

1) smelting, refining and continuous casting comprising smelting, refining, continuous casting metal to obtain a slab for the thick steel plate having a chemical composition in mass percentage: C: 0.05-0.08%, Si: 0.10-0.30%, Mn: 1.2-1.6%, P: ≤0.02%, S: 0.002-0.008%, B. 0.0005-0.005%, Ni: 0.20-0.40°-6, Cu: 0.15-0.3%, Ti: 0.005-0.03%, Al: 0.003-0.03%, Ca: 0.001-0.005%, REM 0.01%, Zr≤0.01%, N: 0.001-0.006%, and the balance of Fe and other inevitable impurities; wherein the chemical composition satisfies the following relationship: 1≤Ti/N≤6, (Ca+REM+Zr)/Al≥0.11;

an effective S content in steel=S-0.8Ca-0.34REM-0.35Zr, which is in a range of 0.0006-0.005%; and the amount of composite inclusion $CaO+Al_2O_3+MnS+TiN$ in the steel plate is controlled at a proportion of 12% of total inclusions;

2) rolling comprising heating the slab to 1050-1250° C., wherein initial rolling temperature is higher than 930° C., cumulative reduction rate is greater than 30%, and wherein finish rolling temperature is less than 930° C., and cumulative reduction rate is greater than 30%; and 3) cooling comprising performing water cooling at a cooling rate of 2 to 30° C./s to a final cooling temperature of 300 to 550° C.; and wherein the thickness of the steel plate is 50-70 mm, the tensile strength of a base material of the steel plate is ≥510 MPa, the average Charpy impact work of the welding heat-affected area of the steel plate at −40° C. is 100 J or more under a condition that welding input energy is 200-400 kJ/cm and the average Charpy aging impact work of the base material of ½ plate thickness at −40° C. is 46 J or more.

4. The method of manufacturing a thick steel plate for high heat input welding and having great heat-affected area toughness according to claim 3, wherein the thick steel plate further comprises at least one element of Nb or Cr, the amount of Nb is 0.03 mass % or less, and the amount of Cr is 0.2 mass % or less.

* * * * *